US006214149B1

(12) United States Patent
Nakano et al.

(10) Patent No.: US 6,214,149 B1
(45) Date of Patent: Apr. 10, 2001

(54) THERMAL TRANSFER SHEET FOR INTERMEDIATE TRANSFER RECORDING MEDIUM

(75) Inventors: Yoshinori Nakano; Mikiko Narita; Katsuyuki Oshima, all of Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/120,530

(22) Filed: Jul. 22, 1998

(30) Foreign Application Priority Data

Jul. 25, 1997 (JP) ..... 9-200574

(51) Int. Cl.[7] ..... B44C 1/00; B41M 3/12; B41M 5/00; B41M 5/035; B41M 5/38

(52) U.S. Cl. ..... 156/235; 156/240; 428/195; 428/354; 428/913; 428/914; 503/227

(58) Field of Search ..... 8/471; 428/195, 428/913, 914, 500, 522, 343, 352, 354; 503/227; 156/230, 235, 239, 240

(56) References Cited

U.S. PATENT DOCUMENTS

| | | | | |
|---|---|---|---|---|
| 5,298,308 | * | 3/1994 | Yamane et al. | 428/195 |
| 5,332,459 | * | 7/1994 | Yamane et al. | 156/234 |

FOREIGN PATENT DOCUMENTS

| | | | | |
|---|---|---|---|---|
| 0799714 | | 10/1997 | (EP) | 428/195 |
| 61-162390 | | 7/1986 | (JP) | 428/195 |
| 61-254394 | | 12/1986 | (JP) | 428/195 |
| 61-286195 | | 12/1986 | (JP) | 428/195 |
| 62-228974 | | 12/1987 | (JP) | 428/195 |
| 01133784 | | 5/1989 | (JP) | 428/488.4 |
| 01146788 | | 8/1989 | (JP) | 428/484 |
| 3-45390 | * | 2/1991 | (JP) | 428/195 |
| 06155995 | | 6/1994 | (JP) | 428/195 |
| 07089296 | | 4/1995 | (JP) | 428/195 |

* cited by examiner

*Primary Examiner*—Bruce H. Hess
(74) *Attorney, Agent, or Firm*—Ladas & Parry

(57) ABSTRACT

A thermal transfer sheet of the present invention is used in order to previously form an image in a receptor layer of the intermediate transfer recording medium before the receptor layer is re-transferred to a transfer receiving material, and it comprises: a substrate film, a peelable layer disposed on the substrate film, and a heat fusible black ink layer disposed on the substrate film via the peelable layer, wherein the peelable layer is formed of a material having peelable property to the substrate film while having adhesive property to the transfer receiving material so that the peelable layer is transferred to the receptor layer of the intermediate transfer recording medium together with the heat fusible black ink layer when the image is formed in the receptor layer so as to constitute an uppermost layer of the receptor layer, the uppermost layer being adhesive to the transfer receiving material.

6 Claims, 1 Drawing Sheet

THERMAL TRANSFER SHEET FOR INTERMEDIATE TRANSFER RECORDING MEDIUM

BACKGROUND OF THE INVENTION

1. Field of the Invention

The present invention relates to a thermal transfer sheet, and in particular to a thermal transfer sheet to be used in order to form an image in a receptor layer of an intermediate transfer recording medium which is one kind of receptor layer-transfer sheets utilized to transfer the receptor layer on a transfer receiving material together with the image previously formed in the receptor layer.

2. Description of the Related Art

Heretofore, there have been known various types of thermal transfer recording methods, in which a thermal transfer sheet, having a substrate sheet on which a coloring material layer is disposed, and a transfer receiving material, on which a receptor layer is disposed, are mutually superposed and pressed between a heating device such as a thermal head and a platen roll, and the heat-generating members of the heating device are selectively heated depending on image information. As a result, the coloring material contained in the coloring material layer of the thermal transfer sheet migrates to the transfer receiving material, realizing the thermal transfer recording. Of these methods, a heat fusion type thermal transfer method and a sublimation type thermal transfer method have been most commonly used.

In the heat fusion type thermal transfer method, a thermal transfer sheet carrying a heat fusible ink layer is heated by the heating device as mentioned above, and softened or molten heat fusible ink is transferred to the transfer receiving material such as a paper made of natural fiber, plastic sheet or the like, thus forming an image. The heat fusible ink layer is composed by dispersing a coloring material such as pigment into heat fusible binder such as wax or resin, and carried on a substrate sheet of the thermal transfer sheet such as plastic film. Images formed by this heat fusion type thermal transfer method have higher density and superior sharpness, and this method is therefore suitable for recording of binary images consisting letters and/or drawings. In addition, it is possible to form a multi-color image by subjecting the transfer receiving material to a transfer process with the use of a thermal transfer sheet having heat fusible ink layers of various colors, for example, three colors comprising yellow, magenta and cyan or four colors further comprising black.

In the sublimation type thermal transfer method as another common method, a thermal transfer sheet carrying a sublimation dye layer is heated by the similar heating device, and the dye is sublimated from the layer and transferred to the transfer receiving material, thus forming an image. The sublimation dye layer is composed by dissolving or dispersing the sublimation dye of the coloring material into a binder resin, and carried on a substrate sheet of the thermal transfer sheet such as plastic film. The sublimation type thermal transfer method is capable of controlling an amount of the transferred dye by each dot depending on extent of energy applied from the heating device such as the thermal head, thus realizing reproduction of gradation via change of density. In addition, since the dye is utilized as the coloring material, the formed image has an improved transparency, thus providing an improved reproducibility of an intermediate color prepared by superposing plural colors with the use of the corresponding dye layers.

Accordingly, it is possible to form a full color or natural color image having a high quality, when the dyes of three or four colors are transferred to the transfer receiving material with the respective colors superposed by using the thermal transfer sheet having the plural sublimation dye layers of three colors comprising yellow, magenta and cyan or four colors further comprising black.

When a color image is formed by the thermal transfer method, additional use of the black ink improves sharpness of the image such as letters or the like transferred to the transfer receiving material. The heat fusible black ink has a further feature that a single color image such as letters, symbol or the like formed by thermally transferring the heat fusible black ink is readable by an optical character reader, and it is particularly utilized to print a bar code or the like. In contrast with this, an image formed by the sublimation type thermal transfer method is inferior in readability on the optical character reader, because infrared absorption of the image is relatively small at about 900 nm. Accordingly, when optical character recognition on a machine is required, the heat fusible black ink is utilized in order to form a single color image of black or a multi-color image comprising black and another color even though most of image is formed by the sublimation type thermal transfer method.

Among the above mentioned thermal transfer methods, transferring performance of the sublimation type thermal transfer method is strictly influenced by dyeability of the transfer receiving material to be provided with the image. Therefore in a case where a surface of the transfer receiving material is short in the dyeability, it is almost impossible to form the image insofar as a receptor layer having the dyeability is formed on the transfer receiving material.

In order to solve the problem mentioned above, Japanese Patent Application Laid-Open (JP-A) Nos. 62-264994 discloses a method in which a receptor layer is peelably formed on a substrate film to prepare a receptor layer-transfer sheet, and the thus formed receptor layer of the receptor layer transfer sheet is transferred onto a transfer receiving material having a poor dyebility, and then a dye contained in a dye layer of a thermal transfer sheet is transferred to the receptor layer of the transfer receiving material to form an image. It is possible to form the image on the transfer receiving material having a poor dyebility according to this method. Japanese Patent Application Laid-Open (JP-A) Nos. 3-45390 discloses a thermal transfer sheet applicable to this method, on which respective sublimation dye layers of yellow, magenta and cyan and a heat fusible black ink layer are alternately arranged side by side with a peelable layer interposing under the heat fusible black ink layer. There is also proposed a peelable layer having a improved durability so as to serve as not only the peelable layer as it is but also a protect layer.

Japanese Patent Application Laid-Open (JP-A) Nos. 62-238791 discloses another method in which a receptor layer is peelably formed on a substrate film to prepare a receptor layer-transfer sheet, and a dye is transferred from a thermal transfer sheet to the thus formed receptor layer of the receptor layer-transfer sheet to previously form an image, and thereafter the receptor layer provided with the image is transferred from the receptor layer-transfer sheet onto a transfer receiving material. According to this method, it is also possible, whether the transfer receiving material has a good dyeability or not, to form the image in the transfer receiving material even if the transfer receiving material has a surface difficult for operating of the heating device, for example, one having a curved surface such as a tumbler, another one of a fixed structure such as a wall and still another one liable to be thermally fused by heating of the thermal head or the like. A receptor layer-transfer sheet applicable to this method is called as an intermediate transfer recording medium. The above mentioned thermal transfer sheet on which the sublimation dye layers of the respective colors and the heat fusible black ink layer are alternately arranged side by side with the peelable layer interposing under the heat fusible black ink layer is similarly used to previously form the image in the intermediate transfer recording medium.

However, if an image is formed in the receptor layer of the intermediate transfer recording medium by transferring the heat fusible black ink layer of the thermal transfer sheet, The transferred heat fusible black ink layer is accompanied by the peelable layer having a poor adhesive property with respect to the transfer receiving material, thereby forming an uppermost layer having a poor adhesive property. Therefore, when the receptor layer provided with the thus formed image is transferred from the intermediate transfer recording medium to the transfer receiving material, adhesion between the image and the transfer receiving material is partially deteriorated. That is, there is caused a defect that a portion of the receptor layer provided with the image formed of the heat fusible black ink layer is hardly bonded to the surface of the transfer receiving material, and loosened therefrom.

SUMMARY OF THE INVENTION

An object of the present invention is therefore to eliminate substantially defects and problems encountered in the prior art described above. More specifically, an object of the present invention is to provide a thermal transfer sheet capable of providing a receptor layer of an intermediate transfer recording medium with an image which has a sharp appearance, an excellent readability on an optical character reader and an improved adhesive property to a transfer receiving material after re-transfer to the transfer receiving material.

To attain the above mentioned object, the present invention provides a thermal transfer sheet for an intermediate transfer recording medium to be used for previously forming an image in a receptor layer of the intermediate transfer recording medium before the receptor layer is transferred to a transfer receiving material, the thermal transfer sheet comprising:

a substrate film, a peelable layer disposed on the substrate film, and a heat fusible black ink layer disposed on the substrate film via the peelable layer, wherein said peelable layer is formed of a material having peelable property to the substrate film while having adhesive property to the transfer receiving material so that the peelable layer is transferred to the receptor layer of the intermediate transfer recording medium together with the heat fusible black ink layer when the image is formed in the receptor layer so as to constitute an uppermost layer of the receptor layer, the uppermost layer being adhesive to the transfer receiving material.

When an image is formed in the receptor layer of the intermediate transfer recording medium by transferring the heat fusible black ink layer of the thermal transfer sheet of the present invention, the peelable layer adhesive to the transfer receiving material is simultaneously transferred to construct an uppermost layer of the portion to which the heat fusible black ink layer is transferred. Therefore, when the receptor layer having the thus formed image is re-transferred from the intermediate transfer recording medium to the transfer receiving material, a portion of the heat fusible black ink layer is fixed on the transfer receiving material via the peelable layer, thereby forming an image on the transfer receiving material with a good adhesion.

It is preferable that the peelable layer of the thermal transfer sheet of the present invention comprises polyvinyl chloride resin or vinyl chloride/vinyl acetate copolymer resin.

The thermal transfer sheet of the present invention may be an integrated type which comprises, in addition to the heat fusible ink layer, a sublimation dye layer of at least one color such as yellow, magenta or cyan so that the respective layers are alternately provided side by side on the substrate film. It comes possible to transfer a multi-color image onto the transfer receiving material with a good adhesion according to this preferred embodiment.

DETAILED DESCRIPTION OF THE PREFERRED EMBODIMENTS

Figure 1:
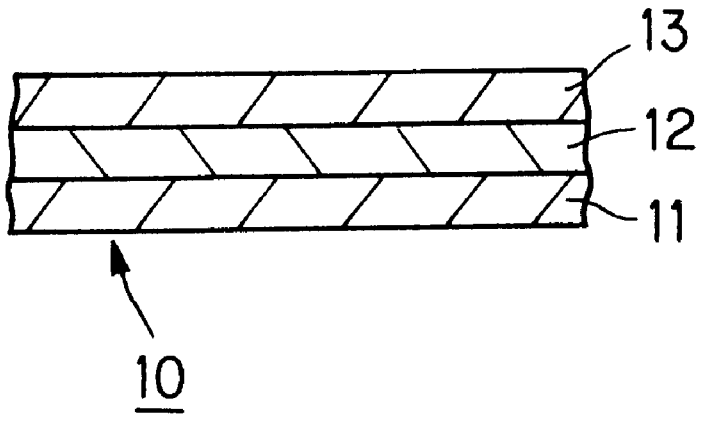
FIG. 1 is a schematically sectional view illustrating one example of the thermal transfer sheet of the present invention; and, FIG. 2 is a schematically sectional view illustrating another example of the thermal transfer sheet of the present invention.

Now, preferred embodiments of the thermal transfer sheet of the present invention will be described in detail with reference to the drawings. FIG. 1 shows a schematically sectional view illustrating a thermal transfer sheet (10) for an intermediate transfer recording medium, which is one example of the present invention. The thermal transfer sheet 10 is composed of a substrate film 11, a peelable layer 12 peelably formed on the substrate film 11, and a heat fusible black ink layer 13 formed on the substrate film 11 via the peelable layer 12.

Figure 2:
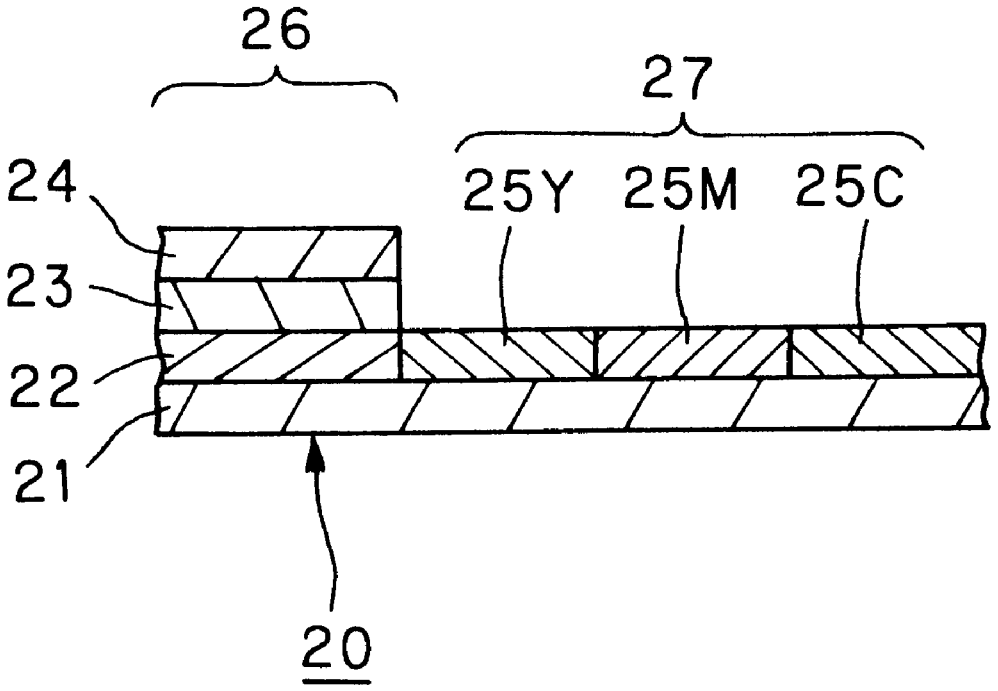

FIG. 2 shows a schematically sectional view illustrating another thermal transfer sheet (20), which is also the example of the present invention. The thermal transfer sheet 20 has a heat fusion transfer portion 26 in which a release layer 22, a peelable layer 23, and a heat fusible black ink layer 24 are laminated in this order and a sublimation transfer portion 27 in which sublimation dye layers of yellow 25Y, magenta 25M and cyan 25C are arranged side by side in this order, and the heat fusion transfer portion 26 and the sublimation transfer portion 27 is alternately and repeatedly provided side by side on the substrate film 21.

Such thermal transfer sheet of the present invention as the above mentioned sheet 10 or 20 is composed of at least the substrate film (11 or 21), the heat fusible black ink layer (13 or 24) and the peelable layer (12 or 23) interposed therebetween. When this thermal transfer sheet is used to carry out the heat fusion type thermal transfer method, at least single color image comprising black is formed on the intermediate transfer recording medium.

The peelable layer (12 or 23) is peelably formed on the substrate film (11 or 21) and interposed between the substrate film (11 or 21) and the heat fusible black ink layer (13 or 24) for the purpose of making the heat fusible black ink layer liable to be transferred to the intermediate transfer recording medium, and accordingly the peelable layer (12 or 23) is formed of a material having peelable property to the substrate film. In addition, the material of the peelable layer (12 or 23) also has an appropriate adhesive property to the transfer receiving material.

The image is formed in the receptor layer of the intermediate transfer recording medium by transferring at least the heat fusible black ink layer (13 or 24) together with the peelable layer (12 or 23). In this transfer process, a positional relationship of the heat fusible black ink layer and the peelable layer is reversed, and the peelable layer (12 or 23) thus transferred constructs an uppermost layer of the intermediate transfer recording medium. When the image integrated with the receptor layer is subsequently re-transferred from the intermediate transfer recording medium to the transfer receiving material, the uppermost layer originated from the peelable layer can serve as an adhesive layer because the peelable layer essentially has an appropriate adhesive property with respect to the transfer receiving material, thereby transferring the image on the transfer receiving material with a good adhesion.

A thermal transfer process of a color image can be carried out by using the thermal transfer sheet 20 in which, as shown in FIG. 2, the respective sublimation dye layers of yellow 25Y, magenta 25M and cyan 25C are alternately arranged on the substrate film 21 together with the heat fusion transfer portion 26. Because the sublimation dye layer 25(25Y, 25M, 25C) is required to have a good adhesive property to the substrate film 21, the substrate film 21 is often surface-treated to improve adhesion. However, when the substrate film 21 is surface-treated to improve adhesion, the peelable layer 23 goes hard to be peeled off the substrate film 21 to the extent that the peelable layer 23 remains thereon. For the purpose of easy peeling of the peelable layer 23, it is preferable to form the release layer 22 between the substrate film 21 and the peelable layer 23. The peelable layer 23 of such an thermal transfer sheet 20 is easily peeled off the release layer 22 at their boundary, and thus transferred to the intermediate transfer recording medium. In contrast to the peelable layer 23, the release layer 22 is formed on the substrate film 21 with a strong adhesion to the extent that the release layer 22 is separated from the peelable layer 23 and remains on the substrate film 21.

Any known layer may be incorporated into the thermal transfer sheet 10 or 20 in accordance with its intended use. More specifically, examples of the additional layers include: a heat resistant layer formed on a back surface of the substrate film 11 or 21 for preventing thermal fusion of the thermal head of the printer; a primer layer interposed between the substrate film 11 or 21 and the peelable layer 12 or 23 for keeping the peelable layer 12 or 23 on the substrate film 11 or 21; an adhesive layer formed on the heat fusible black ink layer 13 or 24 for transferring the heat fusible black ink layer to the intermediate transfer recording medium with a good adhesion; and an antistatic layer formed on a back surface of the substrate film 11 or 21 or a top surface of the heat fusible black ink layer 13 or 24 for preventing the thermal transfer sheet 10 or 20 from adhesion of dust.

As mentioned above, when the intermediate transfer recording medium is subjected to the thermal transfer process by using the thermal transfer sheet of the present invention such as the thermal transfer sheet 10 or 20, the peelable layer bearing the heat fusible black ink layer is smoothly peeled off the substrate film, thus forming the image in the receptor layer of the intermediate transfer recording medium with a good transferability. Because the peelable layer accompanying with the heat fusible black ink layer constructs the uppermost portion of the receptor layer of the intermediate transfer recording medium, and it is adhesive to the transfer receiving material, it also serves, after the intermediate transfer process, an adhesive layer to re-transfer the image from the intermediate transfer recording medium to the transfer receiving material. It is therefore possible to form the image having a good adhesion to the transfer receiving material. In addition, use of the heat fusible black ink enables the optical character recognition and formation of a sharp color image.

With respect to essential or major portions of the thermal transfer sheet of the present invention, materials and methods of preparations will be described below.

[Substrate Film]

The substrate film 11 or 21 of the thermal transfer sheet is formed of a heat resistant material. Any known substrate of the conventional thermal transfer sheet may be used as it is for constructing the thermal transfer sheet of the present invention. The substrate film may be surface-treated to improve adhesion.

Preferable examples of the substrate film include: plastic films such as polyethylene terephthalate, polyester, polycarbonate, polyamide, polyimide, cellulose acetate, polyvinylidene chloride, polyvinyl chloride, polystyrene, nylon, fluoro resin, polypropylene, polyethylene, ionomer or the like; papers such as glassine paper, condenser paper, paraffin paper or the like; cellophane; and composite films formed by laminating the plural materials mentioned above.

Thickness of the substrate film is decided depending on the material thereof so as to control its strength and heat resistance within an appropriate range, and the substrate film usually has a thickness in a range of about 3 to 100 $\mu$m.

[Peelable Layer]

The peelable layer 12 or 23 is formed of a material which is liable to be peeled off the substrate film 11 or 21 while it is adhesive to the transfer receiving material. Preferable materials for the peelable layer include polyvinyl chloride resin and vinyl chloride/vinyl acetate copolymer resin, in particular, vinyl chloride/vinyl acetate copolymer resin. The peelable layer may be formed by coating the resin mentioned above, or coating a coating liquid for the peelable layer which is prepared by dissolving or dispersing the same resin into a proper solvent, through a coating technique such as hot melt coating, hot lacquer coating, gravure coating, gravure reverse coating, roll coating or the like, and then drying or solidifying the thus formed coated layer. A preferable range of thickness of the peelable layer is about 0.2 to 10 $\mu$m.

In a case where the peelable layer is hardly peeled off the substrate film, a release agent may be added into the peelable layer to improve peelability thereof. As the release agent, there may be exemplified silicone oil, phosphoric acid ester-surfactant, fluorine-contained compound or the like.

[Heat Fusible Black Ink Layer]

The heat fusible black ink layer 13 or 24 is formed from an ink comprising a coloring material and vehicle, and further comprising various additives as required.

Carbon black is one of preferable coloring material. Among the organic or inorganic pigments and dyes, the carbon black has superior properties such as a sufficient coloring density, so it is hard to change or fade in color, thus printing a highly dense and sharp image such as letters or characters.

In view of adhesive property to the transfer receiving material and anti-scratch property, the following binder resin are preferably used: acrylic resin, mixture of acrylic resin and chlorinated rubber, mixture of acrylic resin and vinyl chloride/vinyl acetate copolymer resin, mixture of acrylic resin and cellulose resin, and vinyl chloride/vinyl acetate copolymer resin.

Wax or another material may be used as the vehicle instead of the binder resin or in combination with the binder resin. Typical examples of the wax include micro crystalline wax, carnauba wax, paraffin wax or the like. As the wax, there may be further exemplified various ones such as Fischer-Tropsch wax, polyethylene having low molecular weight, Japan tallow, bees wax, spermaceti wax, insect wax, wool wax, shellac wax, candelilla wax, petrolatum, partially modified wax, fat acid ester, fat acid amide or the like.

The heat fusible black ink layer may be formed by coating the black ink mentioned above through a coating technique such as hot melt coating, hot lacquer coating, gravure coating, gravure reverse coating, roll coating or the like, and then drying or solidifying the thus formed coated layer. Thickness of the heat fusible black ink layer is decided depending on optical density and heat sensitivity required respectively, and it is usually in a range of about 0.2 to 10 $\mu$m.

[Sublimation Dye Layer]

The sublimation dye layer of at least one color such as yellow 25Y, magenta 25M or cyan 25C is formed at the sublimation transfer portion 27. The sublimation dye layers of respective colors are formed by carrying the sublimation dye in an proper binder resin, and alternately arranged side by side on the sublimation transfer portion 27 of the substrate film 21.

Any known sublimation dye may be utilized in the present invention without restriction. Examples of the yellow dye include Phorone Brilliant Yellow S-6GL, PTY-52, Macrolex Yellow S-6G or the like. Examples of the magenta dye include MS Red G, Macrolex Red Violet R, Ceres Red 7B, Samaron Red HBSL, SK Rubin SEGL or the like. Examples of the cyan dye include Kayaset Blue 714, Waxoline Blue AP-FW, Phorone Brilliant Blue S-R, MS Blue 100, Daitoh Blue No. 1 or the like.

As the binder resin carrying the sublimation dye, there also may be used any known one without restriction. Examples of the binder resin include cellulose resin such as ethyl cellulose, hydroxy ethyl cellulose, ethyl hydroxy cellulose, hydroxy propyl cellulose, methyl cellulose, cellulose acetate, cellulose acetobutyrate or the like; vinyl resin such as polyvinyl alcohol, polyvinyl acetate, polyvinyl butyral, polyvinyl acetal, polyvinyl pyrrolidone, poly acrylamid or the like. In particular, polyvinyl acetal and polyvinyl butyral are preferable in view of heat resistance and thermal transferability of the dye or the like.

The sublimation dye layer is essentially formed from the dye and the binder resin, and any known additive may be incorporated into the sublimation dye layer as required.

The sublimation dye layer may be formed in such manner that an ink for forming the sublimation dye layer is prepared by dissolving or dispersing the dye, the binder resin and the required additive into a proper solvent, and the ink thus formed is applied on the substrate film by the gravure coating or another coating technique, and then the coated layer is dried.

The sublimation dye layer usually has a thickness in a range of about 0.2 to 5 $\mu$m, and preferably 0.4 to 2 $\mu$m. Amount of the dye contained in the sublimation dye layer is usually in a range of 5 to 90% by weight, and preferably in a range of 10 to 70% by weight with respect to a weight of the sublimation dye layer.

[Release Layer]

The release layer 22 is interposed between the substrate film 21 and the peelable layer 23 for the purpose of making the peelable layer liable to be peeled off the substrate film. The peelable layer is peeled at a boundary between the peelable layer and the release layer, and transferred to the intermediate transfer recording medium while the release layer is kept on the substrate film. As already mentioned, the release layer is particularly effective if the substrate film is surface-treated to improve adhesion.

Such a release layer is preferably formed of a mixture comprising at least urethane resin and polyvinyl acetal resin. The release layer may be formed though the similar technique as in formation of the peelable layer, and a preferable thickness of the release layer is in a range of about 0.1 to 5 $\mu$m.

As mentioned hereinbefore, when the intermediate transfer recording medium is subjected to the thermal transfer process with the use of the thermal transfer sheet of the present invention, the image is formed in the receptor layer of the intermediate transfer recording medium, and at the same time, the uppermost layer serving as the adhesive layer for the re-transfer process is formed at a portion of the receptor layer to which the heat fusible black ink layer is transferred because the heat fusible black ink layer is accompanied by the peelable layer adhesive to the transfer receiving material.

The receptor layer of the intermediate transfer recording medium is transferred to the transfer receiving material together with the thus formed image, and the uppermost layer of the receptor layer is fast adhered to the transfer receiving material, thereby forming the image on the transfer receiving material with a good adhesion. Therefore, according to the present invention, it is possible to transfer a sharp image to the transfer receiving material with a good adhesion, thereby obtaining a printed product having a highly quality image through the technique using the intermediate transfer recording medium.

In addition, according to the present invention, it is possible to make the peelable layer further liable to be peeled off the substrate film by incorporating the release agent into the peelable layer or interposing the release layer between the substrate film and the peelable layer. If a color image is intended to be formed on the transfer receiving material, it is also possible to improve the sharpness and the adhesion of the color image by further providing the sublimation dye layer of at least one color such as yellow, magenta or cyan on the thermal transfer sheet in such manner that the heat fusible black ink layer and the dye layer are alternately arranged side by side.

EXAMPLES

Details of the thermal transfer sheet for the intermediate transfer recording medium of the present invention will be explained below by way of experimental example.

A polyethylene terephthalate(PET) film having a thickness of 6 $\mu$m (LUMIRROR, manufactured by Toray Co., Ltd.) was used as the substrate film, and onto the PET film, the release layer, the peelable layer and the heat fusible black ink layer were formed and laminated in this order, thereby forming the thermal transfer sheet of the present invention. The thermal transfer sheet thus formed had no sublimation dye layer.

The release layer was formed by coating the substrate film with an coating liquid prepared so as to have the following composition at an applied amount of 0.2 g/m$^2$ in a solid component.

| <Composition of Coating Liquid for Release Layer> | |
|---|---|
| Urethane resin (CLYSBON 9004, manufactured by DIC Co., Ltd.) | 20 parts by weight |
| Polyvinyl acetoacetal resin (KS-5, manufactured by Sekisui Chemical Co., Ltd.) | 5 parts by weight |
| Fluorescent whitening agent (UVITEX OB, manufactured by Ciba Geigy Corp.) | 0.5 part by weight |
| Dimethyl formamide | 80 part by weight |
| Methyl ethyl ketone | 120 part by weight |

The peelable layer was formed by coating the release layer with an coating liquid prepared so as to have the following composition at an applied amount of 1 g/m$^2$ in a solid component.

| <Composition of Coating Liquid for Peelable Layer> | |
|---|---|
| Vinyl chloride/vinyl acetate copolymer resin (1000 ALK, manufactured by Denki Kagaku Chemical Co., Ltd.) | 20 parts by weight |
| Epoxy-modified silicone (KP 1800-U, manufactured by Shin-Etsu Chemical Co., Ltd.) | 1 parts by weight |
| Methyl ethyl ketone / toluene (1/1 by weight ratio) | 80 part by weight |

The heat fusible black ink layer was formed by coating the peelable layer with an coating liquid prepared so as to have the following composition at an applied amount of 1 g/m$^2$ in a solid component.

| <Composition of Coating Liquid for Heat Fusible Black Ink Layer> | |
|---|---|
| Acryl/Vinyl chloride/vinyl acetate copolymer resin | 20 parts by weight |
| Carbon black | 10 parts by weight |
| Methyl ethyl ketone / toluene (1/1 by weight ratio) | 70 part by weight |

An image was formed in the receptor layer of the intermediate transfer recording medium by using the thus obtained thermal transfer sheet, and then the receptor layer provided with the image was re-transferred to an identification card(ID card) as the transfer receiving material. As a result, it was observed that the image was formed on the ID card with a good adhesion.

What is claimed is:

1. An image forming method in which an image is formed on a receptor layer of an intermediate transfer recording medium and the image is transferred to a transfer receiving material together with the receptor layer, the method comprising the steps of:

providing an intermediate transfer recording medium provided with a receptor layer;

providing a thermal transfer sheet comprising a substrate film, a peelable layer disposed on the substrate film and having peelable property to the substrate film and adhesive property to the transfer receiving material and a heat fusible black ink layer disposed on the substrate film through the peelable layer;

thermally transferring the heat fusible black ink layer of the thermal transfer sheet to the receptor layer of the intermediate transfer recording medium together with the peelable layer and printing an image of the heat fusible black ink having an outermost layer having the adhesive property to the transfer receiving material; and transferring the image of the heat fusible black ink to the transfer receiving material together with the receptor layer and fixing the image to the transfer receiving material through the outermost layer having the adhesive property.

2. An image forming method according to claim 1, therein said peelable layer comprises vinyl chloride resin or vinyl chloride/vinyl acetate copolymer resin.

3. An image forming method according to claim 1, wherein said peelable layer contains a release agent.

4. An image forming method according to claim 1, wherein said thermal transfer sheet further comprises a sublimation dye layer of at least one of colors of yellow, cyan, magenta, the sublimation dye later and the heat fusible black ink later are alternately provided side by side on the substrate film and wherein said heat fusible black ink layer of the thermal transfer sheet is thermally transferred to the receptor layer of the intermediate transfer recording medium together with the peelable layer to thereby print the image of the heat fusible black ink provided with the outermost layer having the adhesive property to the transfer receiving material, and a sublimation dye in the sublimation dye layer of the thermal sheet is thermally transferred to the same receptor layer to thereby print of a colored image in an overlapped manner.

5. An image forming method according to claim 1, wherein said thermal transfer sheet further comprises a release layer interposed between the substrate film and the peelable layer and the peelable layer is peeled from the release layer at a boundary surface thereof so as to be transferred together with the heat fusible black ink layer.

6. An image forming method according to claim 5, wherein said release layer comprises urethane resin and polyvinyl acetal resin.

* * * * *